US011975809B2

(12) United States Patent
Keever

(10) Patent No.: US 11,975,809 B2
(45) Date of Patent: May 7, 2024

(54) POP UP VEST

(71) Applicant: Joseph Jefferson Keever, Virginia Beach, VA (US)

(72) Inventor: Joseph Jefferson Keever, Virginia Beach, VA (US)

( * ) Notice: Subject to any disclaimer, the term of this patent is extended or adjusted under 35 U.S.C. 154(b) by 0 days.

(21) Appl. No.: 18/239,792

(22) Filed: Aug. 30, 2023

(65) Prior Publication Data

US 2024/0067316 A1 Feb. 29, 2024

Related U.S. Application Data

(60) Provisional application No. 63/402,467, filed on Aug. 30, 2022.

(51) Int. Cl.
*B63C 9/125* (2006.01)
*A41D 13/012* (2006.01)
(Continued)

(52) U.S. Cl.
CPC ..... *B63C 9/1255* (2013.01); *A41D 13/0125* (2013.01); *A41D 27/02* (2013.01);
(Continued)

(58) Field of Classification Search
CPC ..... B63C 9/087; B63C 9/105; B63C 9/1055; B63C 9/11; B63C 9/125; B63C 9/1255; A41D 13/0125; A41D 27/02
See application file for complete search history.

(56) References Cited

U.S. PATENT DOCUMENTS 2,425,206 A * 8/1947 Ripley ..... A41D 13/0125 441/107
3,019,459 A * 2/1962 Ripley ..... B63C 9/1055 441/107
(Continued)

FOREIGN PATENT DOCUMENTS

AU 2021107251 A4 12/2021
WO WO-2012174599 A1 * 12/2012 ..... A41D 13/0125

OTHER PUBLICATIONS

"How to Re-Arm an Inflatable Life Jacket," Bluestorm, Feb. 23, 2022. https://blog.bluestormgear.com/how-to-re-arm-an-inflatable-life-jacket.
(Continued)

*Primary Examiner* — Ajay Vasudeva
(74) *Attorney, Agent, or Firm* — HOLLOWELL PATENT GROUP; Kelly Hollowell

(57) ABSTRACT

Apparatus and associated methods relate to a pop-up vest, illustratively implemented as a flotation apparel item comprising a water sport apparel item, an inflatable Personal Flotation Device (PFD) configured in the water sport apparel item, and an inflation trigger configured to inflate the PFD. The water sport apparel item may comprise a shirt, t-shirt, wetsuit or rash guard. The water sport apparel item may be adapted to retain the PFD between an outer apparel item layer and a base apparel item layer sewn together. The inflation trigger may be a pull tab configured to inflate the PFD when desired. The inflation trigger may be a sensor configured to automatically inflate the PFD when the sensor is wet. An exemplary pop-up vest implementation may be configured with a water activated light to improve visibility. Some pop-up vest designs may comprise a whistle permitting the user to raise awareness of their location.

14 Claims, 8 Drawing Sheets

(51) Int. Cl.
*A41D 27/02* (2006.01)
*B63C 9/11* (2006.01)

(52) U.S. Cl.
CPC ..... *B63C 9/11* (2013.01); *B63C 9/125* (2013.01); *A41D 2400/26* (2013.01)

(56) References Cited

U.S. PATENT DOCUMENTS

| | | | | |
|---|---|---|---|---|
| 5,759,076 | A * | 6/1998 | Bateman | B63C 9/1255 441/115 |
| 7,150,668 | B2 * | 12/2006 | Kemp | B63C 9/125 441/106 |
| 7,699,679 | B2 * | 4/2010 | Lahyani | A41D 7/003 441/89 |
| 8,231,421 | B1 * | 7/2012 | Hubbard | B63C 9/1255 441/103 |
| 8,911,273 | B2 * | 12/2014 | Chouinard | B63C 9/18 441/106 |
| D842,958 | S | 3/2019 | Beach-Drummond | |
| 10,414,475 | B2 * | 9/2019 | Sunol | B63C 9/1255 |
| 2007/0004298 | A1 | 1/2007 | Ganley | |
| 2014/0057510 | A1 | 2/2014 | Beach-Drummond | |
| 2015/0360759 | A1 | 12/2015 | Ashard | |

OTHER PUBLICATIONS

"PFD Label and POS Graphics," U.S. Coast Guard. https://uscgboating.org/multimedia/PFDlabelsgraphics.php.

"PFD Inspection and Maintenance," Mustang Survival. https://mustangsurvival.com/blogs/resources/pfd-inspection-and-maintenance.

* cited by examiner

POP UP VEST

CROSS-REFERENCE TO RELATED APPLICATIONS

This application claims the benefit of U.S. Provisional Application 63/402,467, titled "POP UP VEST," filed on Aug. 30, 2022, by sole inventor and applicant Joseph Jefferson Keever, and this application incorporates the entire contents of the above-referenced application herein by reference.

TECHNICAL FIELD

This disclosure relates generally to a wearable flotation device.

BACKGROUND

A Personal Flotation Device (PFD) provides buoyancy to a user. The user may be a recreational user in or planning to be near water for sports such as surfing, boating, or fishing. The user may be a commercial user involved in business activity such as maritime-related shipping or construction. Buoyancy from the PFD may provide a lifesaving margin of safety to a user that is unexpectedly knocked into the water.

A PFD may be bulky and difficult to transport or keep within reach for emergency situations when the PFD may be needed quickly. Excess bulk of a PFD may restrict a user's movement and inhibit their ability to escape or survive in a dangerous situation. Some PFDs may require substantial effort to inflate, making such devices difficult to use in an emergency. A user may waste substantial time and effort trying to use a PFD that restricts their movement, requires excessive effort to inflate or deploy, and is not instantaneously ready for use in an unexpected scenario.

SUMMARY

Disclosed herein is a pop-up vest, illustratively implemented as a flotation apparel item comprising a water sport apparel item, an inflatable Personal Flotation Device (PFD) configured in the water sport apparel item, and an inflation trigger configured to inflate the PFD. The water sport apparel item may comprise a shirt, t-shirt, wetsuit or rash guard. The water sport apparel item may be adapted to retain the PFD between an outer apparel item layer and a base apparel item layer sewn together. The inflation trigger may comprise a pull tab configured to inflate the PFD when desired. The inflation trigger may comprise a sensor configured to automatically inflate the PFD when the sensor is wet. An exemplary pop-up vest implementation may be configured with a water activated light to improve visibility. Some pop-up vest designs may comprise a whistle permitting the user to raise awareness of their location.

The details of various aspects are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION

Figure 1:
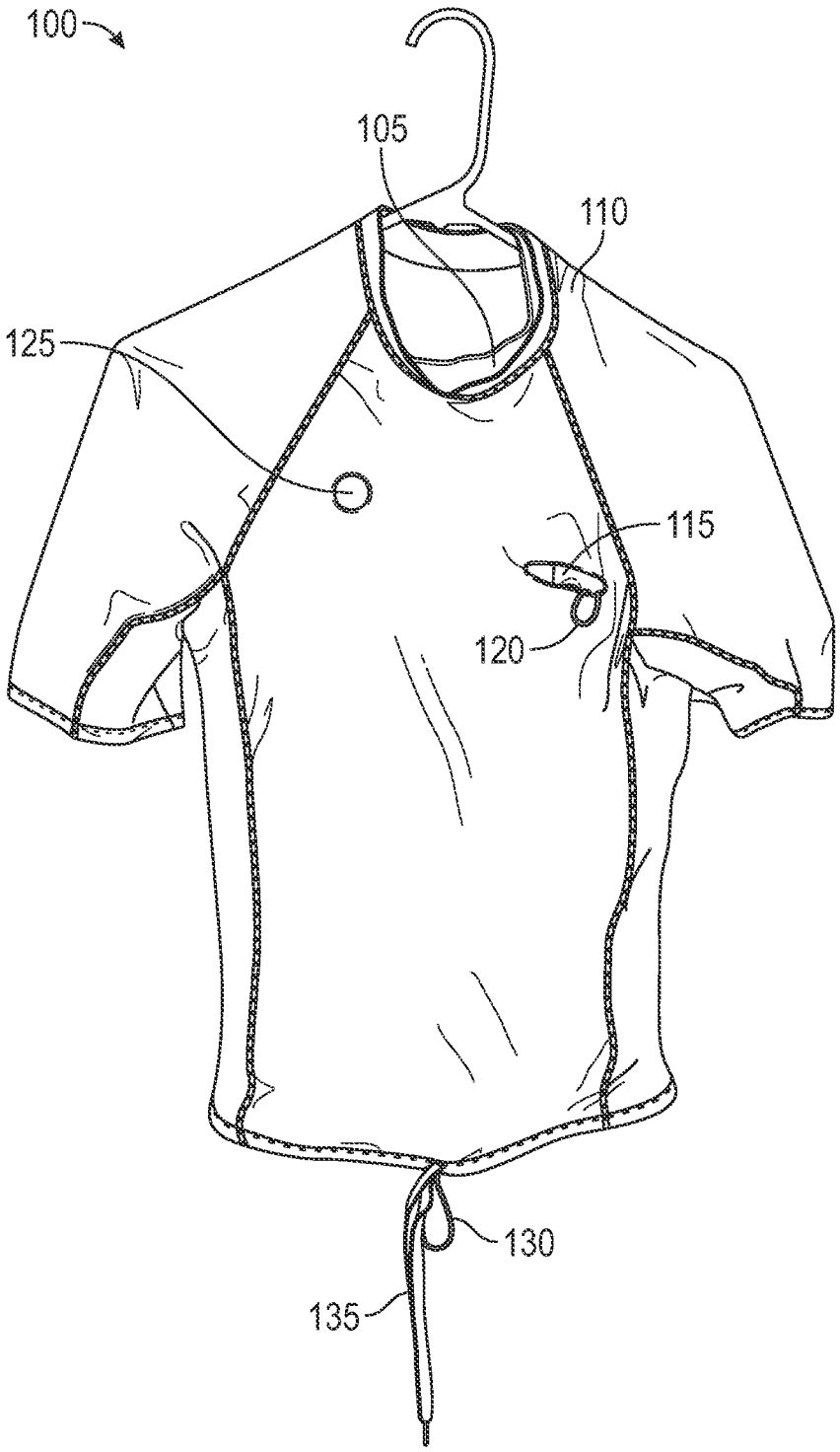
FIG. 1 depicts an exterior front view of an exemplary pop-up vest implementation.

Note that the specific implementations given in the drawings and following description do not limit the disclosure. On the contrary, they provide the foundation for one of ordinary skill to discern the alternative forms, equivalents, and modifications that are contemplated by the inventor and encompassed in the claim scope.

FIG. 1 depicts an exterior front view of an exemplary pop-up vest implementation. In FIG. 1, the exemplary pop-up vest 100 includes the inner layer 105 and the outer layer 110. In the depicted implementation the inner layer 105 is an inner base rash guard. In the depicted implementation the outer layer is an outer rash guard 110. In FIG. 1, the pop-up vest 100 inner layer 105 is visible on the inside edge of the collar of the pop-up vest 100. In FIG. 1, the pop-up vest 100 outer layer 110 is disposed over the inner layer 105. The pop-up vest 100 depicted in FIG. 1 includes the PFD access slot 115. In the depicted implementation the PFD access slot 115 is configured to provide user access to a PFD (depicted by at least FIGS. 7 & 8) for replacing a replaceable pressurized cannister. The pop-up vest 100 depicted in FIG. 1 includes the inflation trigger 120. In the depicted implementation the inflation trigger 120 is a pull tab configured to inflate a bladder in the PFD when the pull tab is activated by a user. In the depicted implementation the pull tab is a pull string. In the depicted implementation the pull string is U-shaped. The U-shape of the pull string may improve a user's ability to reliably pull the pull string to inflate the PFD in an emergency, based on the U-shaped string providing a hook to grab the user's thumb or other finger as the user pulls the pull string away from the pop-up vest 100. In any case, manual inflation of the PFD triggered by user operation of the pull cord prevents unnecessary inflation of the PFD until inflation is actually needed and allows the user to enjoy more freedom of movement while engaged in water sport activities, while the PFD remains un-inflated. A pop-up vest implementation may comprise automatic inflation and manual inflation combined in a single unit. The automatic inflation and manual inflation combined in the single unit may comprise a selectable inflation mode feature. The selectable inflation mode feature may be configured to permit a user to switch the inflation trigger mode between an automatic inflation mode that inflates the PFD upon sensor detection of contact with water or impact, and a manual inflation mode that inflates the PFD when activated by a user (such as by pulling a cord).

With continued reference to FIG. 1, the inflation trigger 120 may be a sensor configured to automatically inflate the PFD when the sensor is wet. The inflation trigger 120 may be a sensor configured to automatically inflate the PFD when the sensor is subjected to mechanical impact, for example as a result of a user falling into water. The inflation trigger 120 may be mechanically connected to a valve configured to govern fluid communication between the PFD bladder and the pressurized cannister. With continued reference to FIG. 1, the valve may be configured to be in fluid communication with an inflation tube accessible using the inflation tube access slot 125. The inflation tube may be configured to permit a user to manually inflate the PFD by exhalation into the inflation tube. The pop-up vest 100 may comprise a light configured in an exterior surface of the pop-up vest 100. The light may be configured to automatically illuminate when the apparatus is in contact with water. The pop-up vest 100 may comprise a whistle. The pop-up vest 100 depicted by FIG. 1 includes the loop 130 disposed at the bottom front of the pop-up vest 100. The loop 130 may be tied into the board shorts, bathing suit, shorts or pants being worn by the user. The pop-up vest 100 depicted by FIG. 1 includes the drawstring 135 disposed at the bottom front of the pop-up vest 100. The drawstring 135 may be tied around the waist by the user. The drawstring 135 may be tied into board shorts, bathing suit, shorts or pants worn by the user. The pop-up vest 100 may comprise reflective safety strips sewn on the exterior of the pop-up vest 100. In FIG. 1, the pop-up vest 100 is depicted on a hanger in an exemplary storage configuration. The pop-up vest 100 may be configured with a center front zipper that may permit easier user access in and out of the pop-up vest 100. The center front zipper may be disposed vertically in the front and configured to releasably join the sides of the vest wherein the vest may be configured with two pouches, one pouch on either side of the vest zipper for the PFD.

Figure 2:
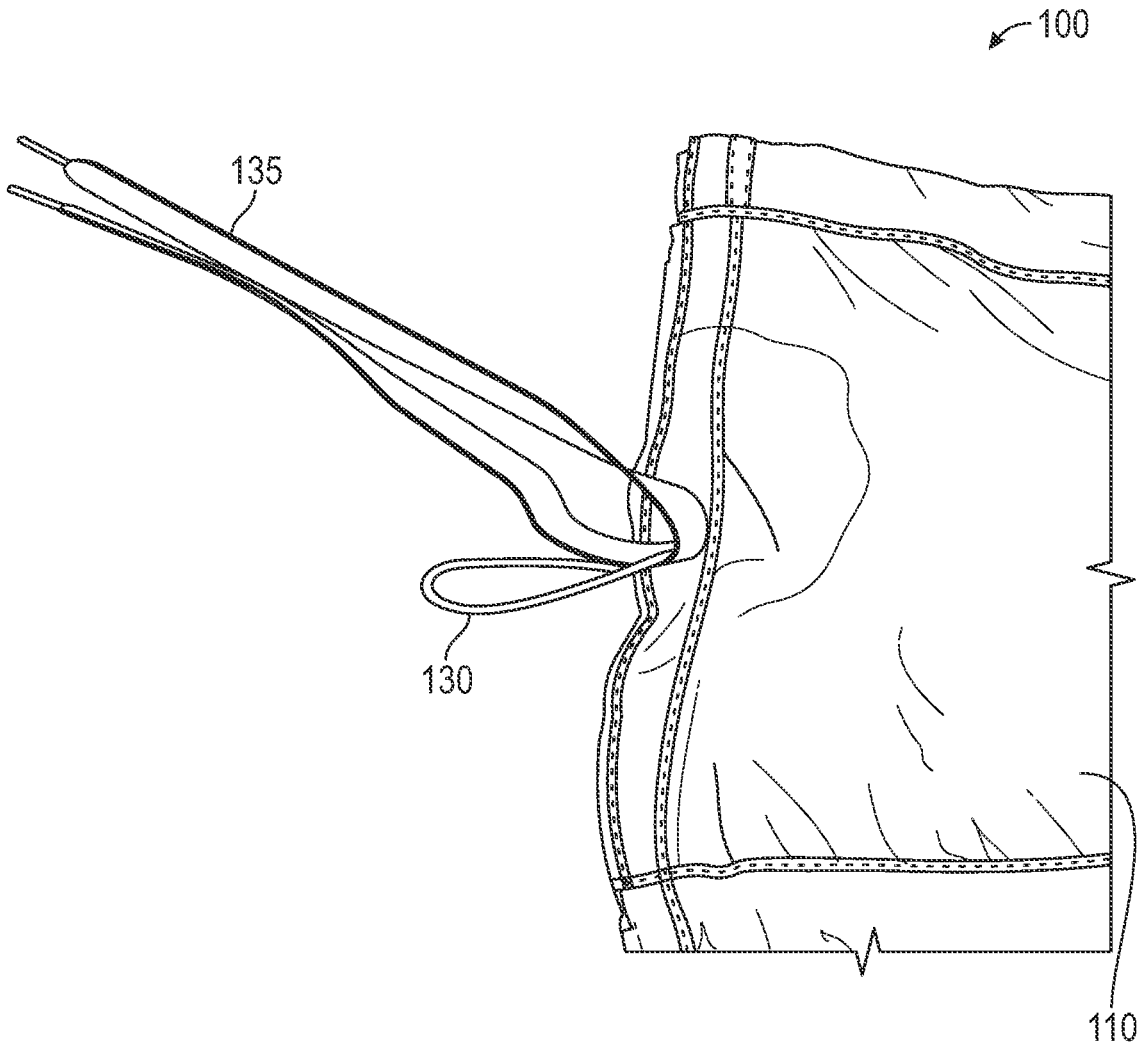
FIG. 2 depicts an exterior lower front view of an exemplary pop-up vest implementation.

FIG. 2 depicts an exterior lower front view of the exemplary pop-up vest 100 implementation illustrated by FIG. 1.

Figure 3:
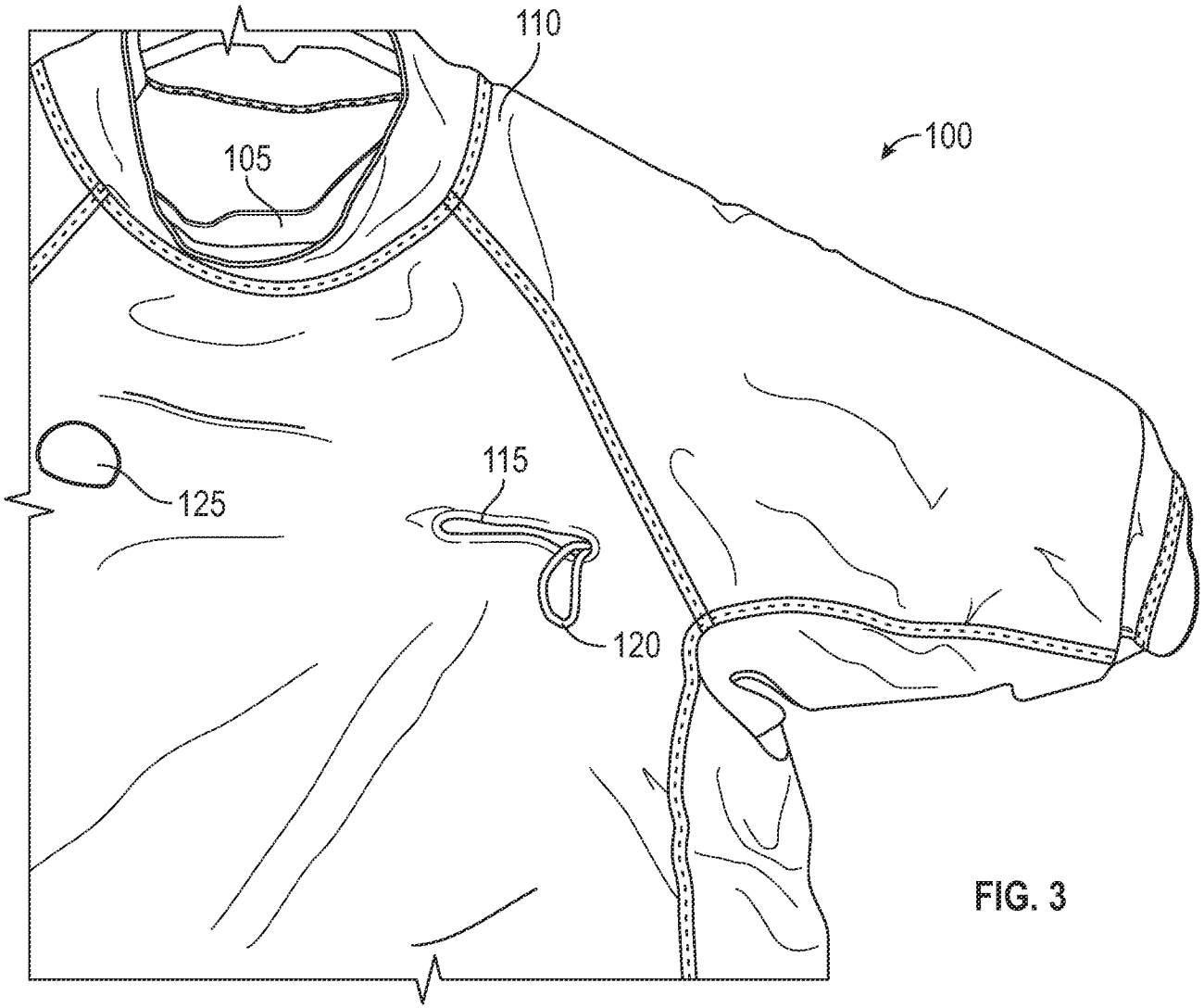
FIG. 3 depicts an exterior left front view of an exemplary pop-up vest implementation.

FIG. 3 depicts an exterior left front view of the exemplary pop-up vest implementation 100 illustrated by FIG. 1.

Figure 4:
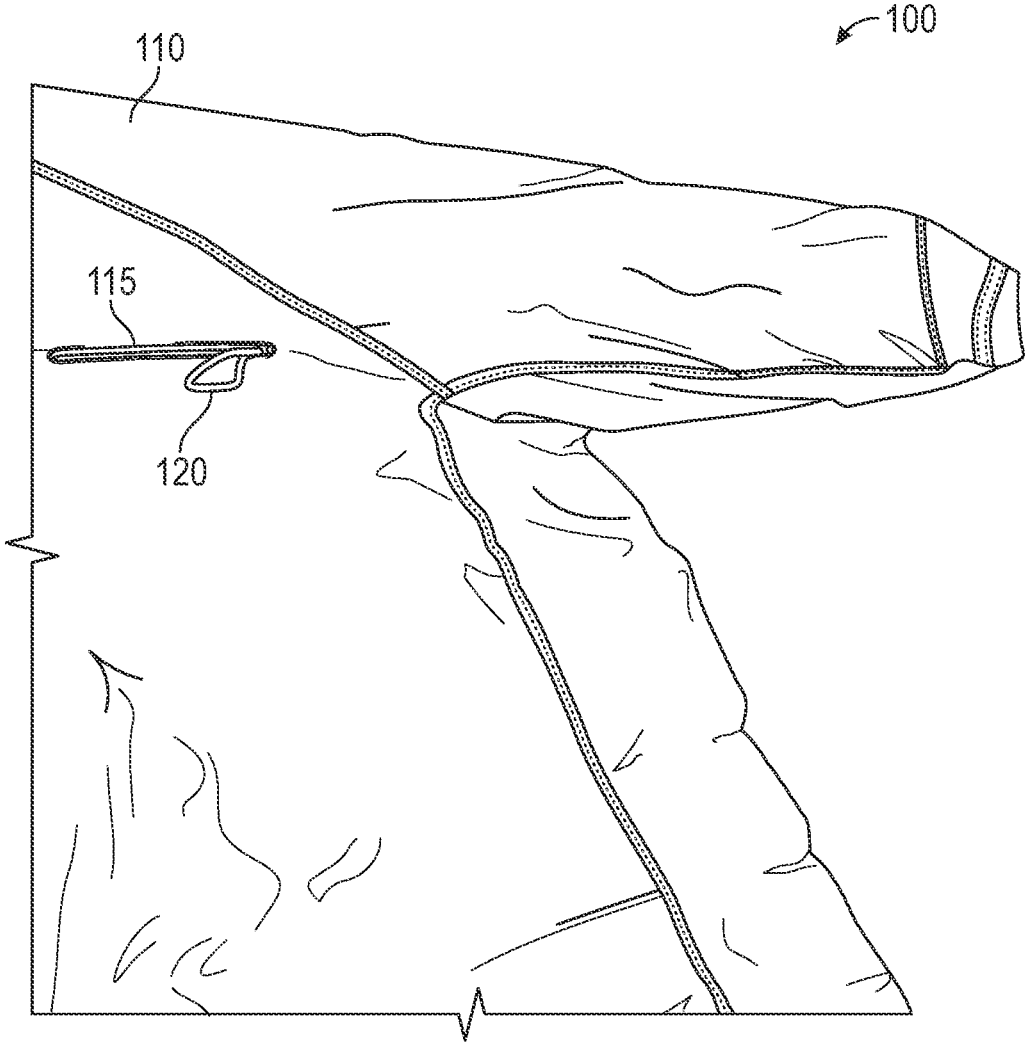
FIG. 4 depicts an exterior left front view of an exemplary pop-up vest implementation.

FIG. 4 depicts an exterior left front view of an exemplary pop-up vest implementation 100 illustrated by FIG. 1.

Figure 5:
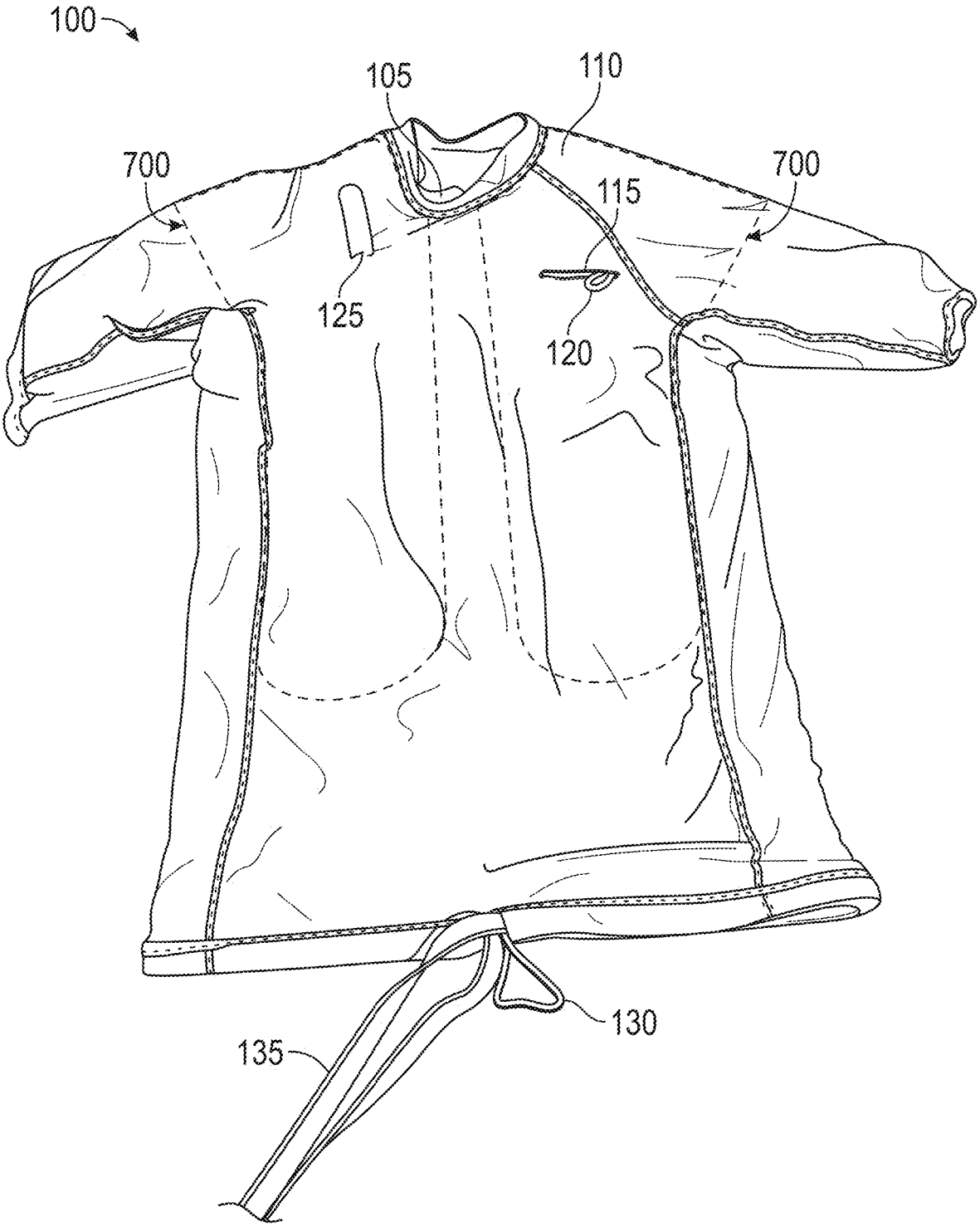
FIG. 5 depicts an exterior front view of an exemplary pop-up vest implementation.

FIG. 5 depicts an exterior front view of the exemplary pop-up vest implementation 100 illustrated by FIG. 1. In FIG. 5, the pop-up vest 100 is depicted on a clothes hanger in an exemplary storage configuration. In the implementation depicted by FIG. 5 the inflation tube access slot 125 provides access to the inflation tube protruding through the inflation tube access slot 125.

Figure 6:
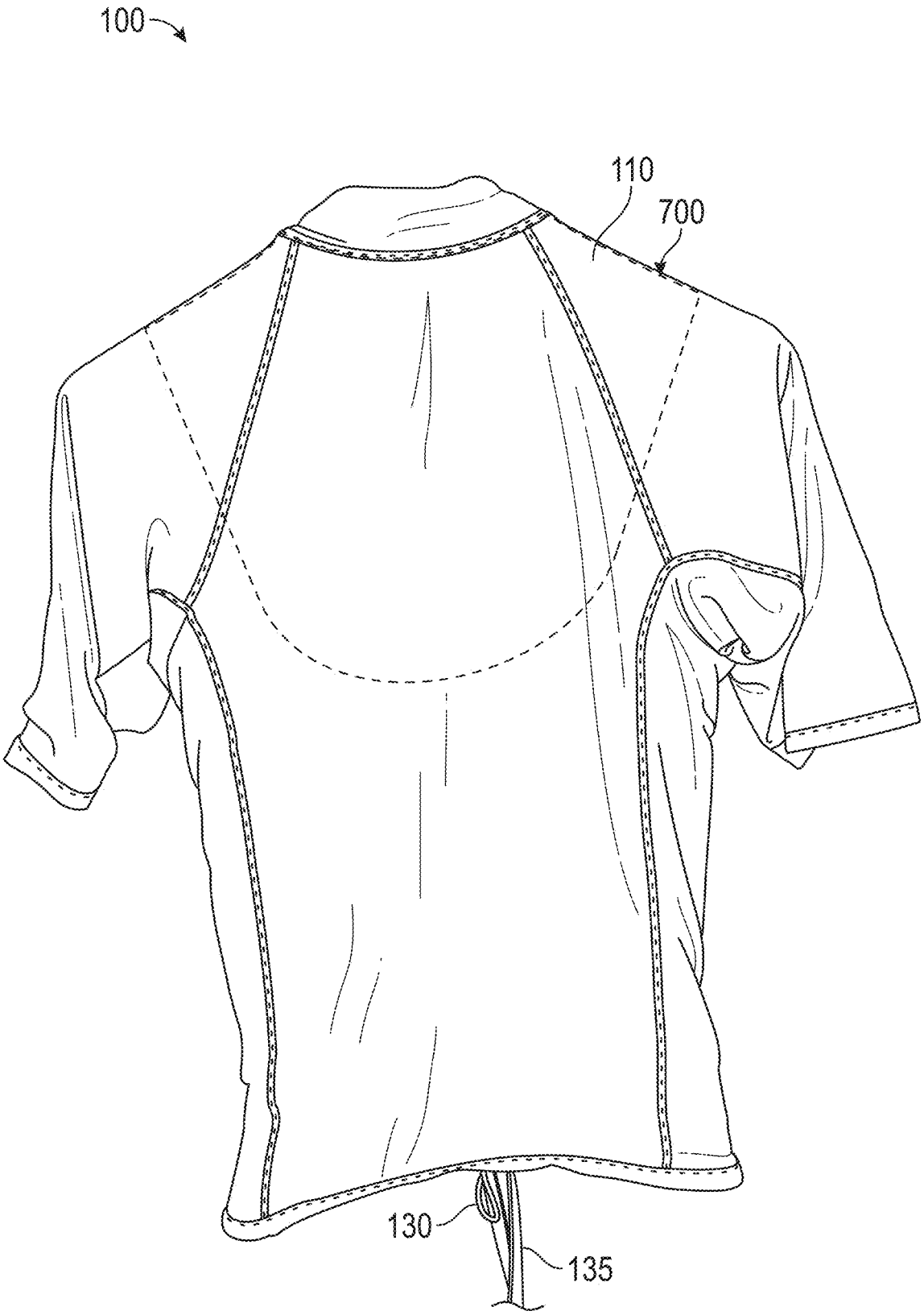
FIG. 6 depicts an exterior rear view of an exemplary pop-up vest implementation.

FIG. 6 depicts an exterior rear view of the exemplary pop-up vest implementation 100 depicted by FIG. 1. In FIG. 6, the pop-up vest 100 is depicted on a clothes hanger in an exemplary storage configuration.

Figure 7:
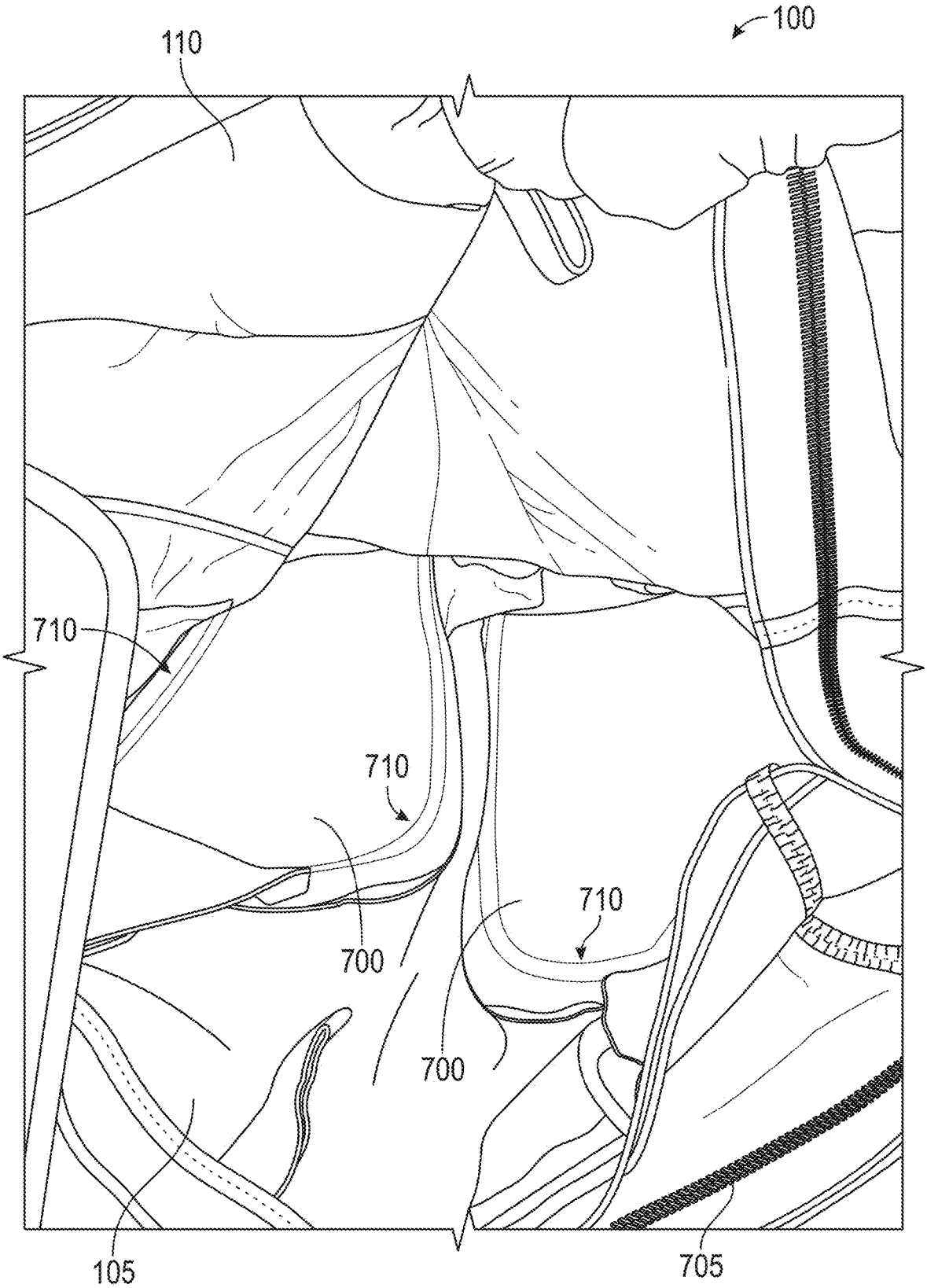
FIG. 7 depicts a bottom perspective view of an exemplary pop-up vest implementation in an illustrative display configuration showing exemplary internal components.
Figure 8:
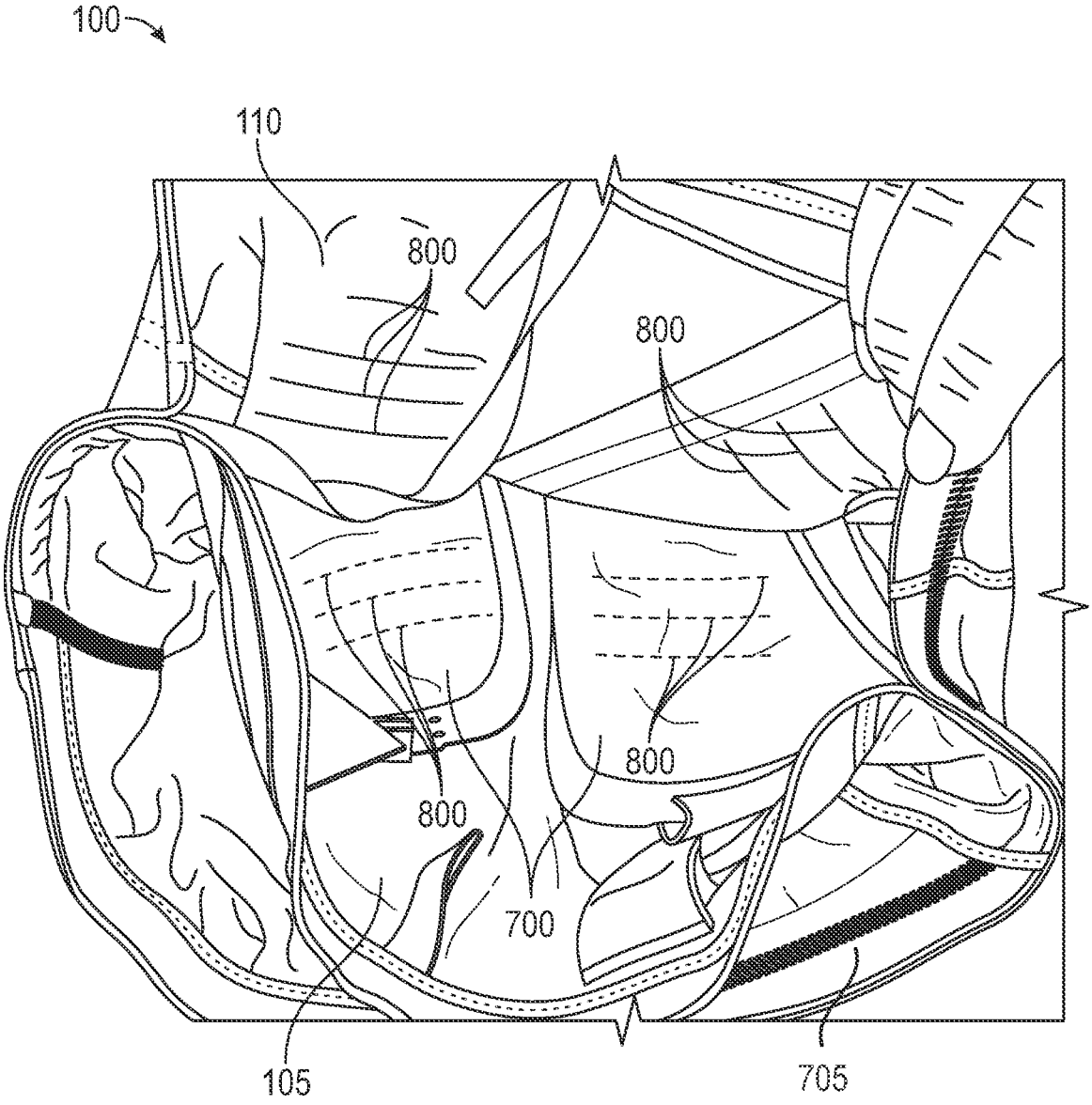
FIG. 8 depicts a bottom perspective view of an exemplary pop-up vest implementation in an illustrative display configuration showing exemplary internal components.

FIG. 7 depicts a bottom perspective view of an exemplary pop-up vest implementation in an illustrative display configuration showing exemplary internal components. FIG. 7 includes the exemplary pop-up vest 100 features disclosed with reference to FIGS. 1-6. In FIG. 7, the PFD 700 is disposed between the outer layer 110 and the inner layer 105 of the pop-up vest 100. In the depicted implementation the pop-up vest 100 comprises a fabric garment retaining the PFD 700 in a void between the outer layer 110 and the inner layer 105. The PFD 700 comprises an inflatable bladder sewn with stitching 710 into the front sides and around the upper back of the garment with an inside pocket/liner of fabric. In the depicted implementation the inflatable PFD 700 bladder is positioned along the front sides and around into the back side and beneath the exterior of the pop-up vest 100. The PFD 700 may be sewn into the pop-up vest 100 using a similar fabric to enclose the PFD. FIGS. 7 & 8 show the zipper 705 configured to detachably attach the outer layer 110 and inner layer 105. The zipper 705 may be omitted from the pop-up vest 100. The outer layer 110 and inner layer 105 may be sewn together in the pop-up vest 100, instead of employing the zipper 705 as illustrated.

FIG. 8 depicts a bottom perspective view of an exemplary pop-up vest implementation in an illustrative display configuration showing exemplary internal components. FIG. 8 includes the exemplary pop-up vest features disclosed with reference to FIGS. 1-7. In FIG. 8, the exemplary pop-up vest 100 includes the plurality of ribs 800. The ribs 800 are structural supports adhered to the inside of the outer rash guard 110 and to the inside of the inner layer 105. The ribs 800 are configured to provide structural support to the pop-up vest 100 to prevent the outer rash guard 110 or the inner layer 105 from crumpling, folding or developing kinks while the PFD 700 remains uninflated. For example, the outer rash guard 110 or the inner layer 105 may fold, kink or crumple in a scenario wherein the pop-up vest 100 is in storage or is worn by a smaller person. Such folding, kinking or crumpling of the outer rash guard 110 or the inner layer 105 may prevent the PFD 700 from readily or fully inflating when needed. The ribs 800 may prevent the pop-up vest outer rash guard 110 or inner layer 105 from folding or crumpling in such a scenario, increasing the likelihood the PFD 700 will fully inflate when needed and preserving and enhancing the intended emergency flotation and lifesaving capability and benefit of the pop-up vest 100. In the depicted implementation each of the ribs 800 comprise boning strips. The boning strips are disposed laterally with respect to the PFD 700. The boning strips 800 are disposed within the void. The boning strips subsume the PFD 700. Ribs 800 may be adhered to the inside of the outer rash guard 110. Ribs 800 may be adhered to the inside of the inner layer 105. The ribs 800 may be folded to create channels to provide rigid support for the PFD 700. Channels may be created in the void between the inner base rash guard 105 and the outer rash guard 110 based on folding and/or sewing the outer rash guard 110 and/or the inner base rash guard 105, wherein the channels may be configured to secure ribs 800 slidably engaged with respective channels to provide rigid support for the PFD 700. In the implementation depicted by FIG. 8, there are four sets of ribs 800. The ribs 800 are adhered to the inner fabric surfaces of the apparatus in line with what has been described above. In FIG. 8, the upper two sets of ribs 800 are visible on the inside of the outer rash guard 110, and these ribs 800 are shown by solid lines. The lower two sets of ribs 800 are not visible on the inner base rash guard 105 under the PFD 700, and these strips are shown by dashed lines.

An exemplary flotation apparel (100) apparatus may comprise: a t-shirt shaped water sport apparel item, comprising an inner base rash guard (105) having an inside surface, outside surface, front surface, back surface, top, bottom and shoulder area that is configured to be in contact with an upper torso of a user and an outer rash guard (110) having an inside surface, outside surface, front surface, back surface, top, bottom and shoulder area that is configured to be in contact with an aquatic environment, wherein the inner base rash guard (105) is sewn to the outer rash guard (110) creating a head hole at the top, a right arm hole, a left arm hole, an open bottom and a void between the inner base rash guard (105) and the outer rash guard (110); an inflatable Personal Flotation Device (PFD) (700) comprising a bladder having a valve mechanically connected to an inflation trigger and an inflation tube, said PFD (700) located over a portion of the inside front of the inner base guard (105)

across the shoulders, encircling the back of the head hole, within the void and sewn to the inside front of the inner base rash guard (105) between the inner base rash guard (105) and the inside front of the outer rash guard (110); wherein the PFD (700) is configured to automatically inflate by a replaceable pressurized cannister in fluid communication with the PFD (700) when the replaceable pressurized cannister is activated by the inflation trigger (120) that is mechanically connected to the replaceable pressurized cannister; and a plurality of slots comprising at least one PFD access slot (115) and at least one inflation tube access slot (125), wherein the plurality of slots traverse the outer rash guard (110) from the outside to the inside of the outer rash guard (110), wherein the at least one PFD access slot (115) provides user access to the PFD (700) for replacing the replaceable pressurized cannister, wherein the at least one inflation tube access slot (125) provides user access to the inflation tube, and wherein the inflation tube is configured to permit a user to manually inflate the PFD (700) by exhalation.

The inflation trigger (120) may further comprise a pull tab proximal to the front left arm hole of the outside front of the outer rash guard (110), wherein the pull tab is configured to inflate the PFD (700) when the pull tab is activated by a user.

The inflation trigger (120) may further comprise a sensor configured to automatically inflate the PFD (700) when the sensor is wet.

The apparatus may further comprise a light configured in the outside of the outer rash guard (110).

The light may be configured to automatically illuminate when the apparatus is in contact with water.

The apparatus may further comprise a whistle attached to the flotation apparel item.

The water sport apparel item may further comprise ultraviolet light (UV) protection.

The replaceable pressurized cannister may be located within the void of the flotation apparel, and wherein the replaceable pressurized cannister is accessible by at least one slot of the plurality of slots.

The t-shirt may be a wet suit.

The apparatus may further comprise a plurality of ribs (800) comprising boning strips disposed within the void and subsuming the PFD (700), wherein the plurality of ribs (800) are adhered to the inside of the outer rash guard (110) and the inside of the inner base guard (105).

The ribs (800) may be folded to create channels to provide rigid support for the PFD (700).

An exemplary method to make flotation apparel (100) may comprise: configuring a t-shirt shaped water sport apparel item, comprising an inner base rash guard (105) having an inside surface, outside surface, front surface, back surface, top, bottom and shoulder area that is configured to be in contact with an upper torso of a user and an outer rash guard (110) having an inside surface, outside surface, front surface, back surface, top, bottom and shoulder area that is configured to be in contact with an aquatic environment, wherein the inner base rash guard (105) is sewn to the outer rash guard (110) creating a head hole at the top, a right arm hole, a left arm hole, an open bottom and a void between the inner base rash guard (105) and the outer rash guard (110); configuring an inflatable Personal Flotation Device (PFD) (700) comprising a bladder having a valve mechanically connected to an inflation trigger (120) and an inflation tube, said PFD (700) located over a portion of the inside front of the inner base guard (105) across the shoulders, encircling the back of the head hole, within the void and sewn to the inside front of the inner base rash guard (105) between the inner base rash guard (105) and the inside front of the outer rash guard (110); wherein the PFD (700) is configured to automatically inflate by a replaceable pressurized cannister in fluid communication with the PFD (700) when the replaceable pressurized cannister is activated by the inflation trigger (120) that is mechanically connected to the replaceable pressurized cannister; and configuring a plurality of slots comprising at least one PFD access slot (115) and at least one inflation tube access slot (125), wherein the plurality of slots traverse the outer rash guard (110) from the outside to the inside of the outer rash guard (110), wherein the at least one PFD access slot (115) provides user access to the PFD (700) for replacing the replaceable pressurized cannister, wherein the at least one inflation tube access slot (125) provides user access to the inflation tube, and wherein the inflation tube is configured to permit a user to manually inflate the PFD (700) by exhalation.

The inflation trigger (120) may further comprise a pull tab.

The pull tab may be disposed proximal to the front left arm hole of the outside front of the outer rash guard (110).

The pull tab may be configured to inflate the PFD (700) when the pull tab is activated by a user.

The method may further comprise configuring the inflation trigger (120) with a sensor designed to automatically inflate the PFD (700) when the sensor is wet.

The method may further comprise configuring a light in an outside surface of the outer rash guard (110).

The method may further comprise configuring the light to automatically illuminate when the flotation apparel is in contact with water.

The method may further comprise configuring a whistle to attach to the flotation apparel.

The method may further comprise configuring the flotation apparel with ultraviolet light (UV) protection.

The replaceable pressurized cannister may be located within the void of the flotation apparel, and wherein the replaceable pressurized cannister is accessible by at least one slot of the plurality of slots.

The t-shirt may be a component of a wet suit.

The method may further comprise configuring a plurality of ribs (800) comprising boning strips disposed within the void and subsuming the PFD (700).

The method may further comprise adhering the plurality of ribs (800) to the inside of the outer rash guard (110).

The method may further comprise creating channels in the void between the inner base rash guard (105) and the outer rash guard (110) based on folding and/or sewing the outer rash guard (110) and/or the inner base rash guard (105), wherein the channels are configured to secure ribs (800) slidably engaged with respective channels to provide rigid support for the PFD (700).

Various implementations have been described with reference to the drawings. However other implementations are possible. For example, an exemplary pop-up vest implementation may comprise a Water sport apparel (shirt) design. An exemplary Water sport apparel (shirt) implementation of the disclosed pop-up vest may comprise an inflatable United States Coast Guard (USCG) approved Personal Floatation Device inside the pop-up vest, with a pull tab to inflate when needed. Such an exemplary pop-up vest implementation may be worn while on or in the water to provide the individual with the ability to inflate the vest in a time of need to reach a safe destination. The pop-up vest may be manufactured in one or more colors and sized for adults and children. The pop-up vest may have sleeveless, short sleeve or long sleeve styles. The pop-up vest may provide sun protection for the user. The pop-up vest may be made of a fabric that stretches and is flexible without restriction of movement. The pop-up vest may be worn over a wetsuit. The pop-up vest may be modified to be part of a wetsuit to provide the same safety comfort for the user in cold conditions. The pop-up vest may be used in all water sport activities such as but not limited to: Surfing, Kite Surfing, Wind Surfing, Kayaking, Fishing, Sailing, Boating, Canoeing, and the like. The pop-up vest provides the user with the safety of knowing they have a lifeline should conditions warrant the need for using a PFD, without restricting the user's ability to fully enjoy the water sports they are engaged in.

An exemplary pop-up vest implementation may comprise a Commercial/Industrial apparel (T-shirt) design. An exemplary Commercial/Industrial apparel (T-shirt) implementation of the disclosed pop-up vest may comprise an inflatable USCG approved Personal Floatation Device inside the pop-up vest, with an automatic water sensor to inflate the PFD if in the water, to provide a safer and more efficient work environment. Such an exemplary pop-up vest implementation may be worn over clothing. The pop-up vest may be manufactured in adult sizes with sleeveless, short sleeve or long sleeve styles. The pop-up vest may have one or more lights on the exterior of the pop-up vest. The one or more lights on the exterior of the pop-up vest may be configured to automatically illuminate when in contact with the water. The pop-up vest may be configured with a whistle attached to the vest for added safety. The pop-up vest provides the commercial and industrial maritime industry with an improved PFD for employees engaged in working on or around water without the restriction of a typical PFD. The pop-up vest provides both the user and industry a more comfortable and efficient option of using a PFD within the workplace.

These disclosed pop-up vest implementations provide water sports enthusiasts and commercial maritime workers with a comfortable and efficient way to add a safety factor that many do not have today. An exemplary pop-up vest implementation may comprise one or more rash guards or sun shirts configured with a USCG approved PFD sewn on top of a base rash guard and then a sleeveless outer rash guard will be sewn onto the PFD and the sleeveless outer rash guard sewn to the base rash guard. The outer rash guard may be referred to as the top layer or the outer layer. The base rash guard may be referred to as the bottom layer or the inner layer. The top layer may be configured with slots permitting user access to an inflation device for inflating the PFD. The inflation device may be a pressurized cannister or cartridge. The slots may permit a user to install and remove the replaceable cannister or cartridge. The cannister or cartridge may be pressurized to automatically inflate a bladder within the PFD. The PFD may be configured to be in fluid communication with the replaceable cannister or cartridge. The valve may be mechanically connected to an inflation trigger and an inflation tube. The top layer may be configured with a slot for access to the manual inflation tube for the PFD, on the opposite side of the pop-up vest front from the inflation device access slot. The pop-up vest may have a drawstring around the waist to be tied snug by the user and can be tied into the board shorts, bathing suit, shorts or pants being worn. The pop-up vest may have a loop on the bottom front. The loop may be tied into the board shorts, bathing suit, shorts or pants being worn by the user. In some examples, the loop or drawstring may be, for example, a belt, a strap, or any other type of fastener known to one of ordinary skill in the art. When needed to inflate the vest for water sports the user may pull the pull tab to inflate the PFD and begin to make their way to safety.

An exemplary water sports version of the pop-up vest may omit the automatic inflation trigger configured to automatically inflate the PFD when wet, because the PFD in such configuration would inflate when not needed, i.e., while the user was safely engaged in water sport activity. The inflated PFD would restrict movement of the user safely engaged in water sport activity. By contrast with such a water sports version of the pop-up vest, an exemplary commercial application of the pop-up vest may include the automatic inflation trigger configured to automatically inflate the PFD when wet. Automatically inflating the PFD when wet provides improved safety for the commercial user if they hit their head or are injured and fall into the water. An exemplary commercial pop-up vest design may have a water activated light on the vest for visibility and a whistle for the user to blow into for greater awareness of the user location. An exemplary water sports pop-up vest implementation may include a whistle.

A pop-up vest implementation in accordance with the present disclosure may achieve one or more technical effects. For example, a pop-up vest implementation may have a low profile similar to the low-profile appearance of a typical rash guard. Such a low-profile pop-up vest may be more user friendly and encourage more users to add this as a safety factor, when most recreational users today use no water safety equipment on the water. Such a low-profile form factor may be a result of a pop-up vest designed to retain the PFD between an outer apparel item layer and a base apparel item layer sewn together. A pop-up vest implementation in accordance with the present disclosure may increase a PFD user's available options for improved comfort with enhanced safety, in contrast with products available today. Such increased options for improved comfort and safety may be a result of a low-profile pop-up vest implementation configured with an auto inflate PFD option. For example, maritime workers or users in marine-related commercial applications may find wearing traditional PFD's that are bulky and restrict movement result in dangerous situations. Such maritime workers' comfort, freedom of movement and safety may be improved as a result of an auto inflate PFD retained between an outer apparel item layer and a base apparel item layer of the low-profile pop-up vest design disclosed herein. Some pop-up vest implementations may improve a user's freedom of movement while increasing safety as a result of reduced potential to snag on working lines or equipment. Such reduced potential to snag on lines or dangerous equipment while providing safety and enhanced freedom of movement may be a result of a sleeveless pop-up vest design providing a safety vest wearable over another shirt or jacket. Such a sleeveless pop-up vest design may be cooler than a traditional prior art PFD, encouraging usage and reducing the chance a user's movement will be restricted. For example, a sleeveless pop-up vest design may improve worker efficiency and safety, as a result of increased freedom of movement contrasted with a bulky prior art device.

Some pop-up vest implementations may improve a user's comfort while being less restrictive and more flexible to accommodate users' movement. Such increased flexibility and comfort may be a result of a pop-up vest design without fabric straps on the sides that may restrict movement as in some prior art examples that may have large bulky plastic fasteners that reduce comfort and restrict movement. A pop-up vest implementation configured as a t-shirt may be worn by itself or over other clothing while providing the disclosed safety and comfort benefits of the exemplary designs. The pop-up vest material may be made in a color or colors to appear similar to a safety shirt.

In illustrative examples a pop-up vest implementation in accordance with the present disclosure may be designed not just for big wave surfers, but designed for all ages and abilities for being in the water whether surfing, stand up paddle boarding, kite surfing, kayaking, fishing, boating, duck hunting, canoeing, sailing, and the like. An exemplary pop-up vest in accordance with the present disclosure may look like a T-shirt, is not bulky and the low profile provides the advantage of giving the user the comfort of having a safety net while offshore enjoying their pursuits. In some implementations the "T-Shirt" can be worn by itself as the color can be made to match colors or patterns typical on a safety shirt or other clothing such as a uniform. With the sleeveless option an exemplary pop-up vest implementation truly is a vest over another shirt or jacket that reduces the chance a worker might snag a line or get caught in debris, unlike existing PFD's that can often snag on a line or restrict the movement and efficiency of the employee during a work shift. In addition, with the sleeveless option an exemplary pop-up vest implementation is much cooler to wear than a traditional PFD in warmer climates. An exemplary pop-up vest implementation may be configured without fabric straps on the sides or large bulky plastic fasteners. In an illustrative example a pop-up vest designed without using fabric straps or large bulky plastic fasteners may improve user comfort and may make using the device less restrictive and more flexible for users, than a design using fabric straps on the sides or large bulky plastic fasteners.

An exemplary pop-up vest implementation may use fabric for the apparel (shirt material) such as but not limited to: Lycra, Spandex/Lycra, Xtra-Life Nylon Lycra, and the like.

An exemplary pop-up vest implementation may be configured with an inflation trigger comprising a USCG approved PFD auto water sensor and an inflatable life vest with replaceable cartridges and auto water activated light and whistle.

In an illustrative example a pop-up vest implementation may be designed with an inflation trigger comprising a USCG approved PFD pull tab and a life vest with replaceable cartridges.

In illustrative examples, the openings for the pull tab and/or the manual inflate tube may be configured in various sizes, and may be larger, or smaller than those depicted by the Drawings. For example, the openings for the pull tab and/or the manual inflate tube may be configured to be smaller or may have VELCRO or some type of fold to avoid seeing into the PFD under the fabric.

In some implementations fabric for a fastener (or draw string) for the waist band may be fabric such as, but not limited to nylon, textured polyester, spun polyester and polypropylene as well as traditional or natural materials.

Various designs may comprise fabric for a fastener (or loop) at front bottom of an exemplary pop-up vest. The fastener may comprise material such as, but not limited to nylon, textured polyester, spun polyester and polypropylene as well as traditional or natural materials.

Other fabrics may be substituted in exemplary pop-up vest components, as might be known to one of ordinary skill in the art.

Users that may benefit from an exemplary pop-up vest implementation designed in accordance with the teaching of the present disclosure may include all water sports and maritime related businesses, including construction companies working on, or above water. Water sport users of a pop-up vest may include, for example, surfers, SUP's, Kite surfers, kayakers, canoeing, fishing, boating, sailing and all water sports and commercial and industrial maritime users working or playing on or near the water. In addition, users of all types of water vessels such as ships and air vessels such as aircraft may benefit from an improved PFD for crew members and passengers, and some designs may be more applicable for airline passengers as a PFD. For example, airlines may tell their passengers to inflate the PFD before sliding down the slide in an emergency, however this commercial pop-up vest application would give the passenger better movement without inflating the PFD until absolutely needed when in the water. Implementations in accordance with the present disclosure provide a revolutionary change for safety. This product has the potential to revolutionize water safety recreationally and commercially due to the comfort and ease of the product for the users.

In illustrative examples a pop-up vest design in accordance with the teaching of the present disclosure may improve a user's ease of access to personal flotation in an emergency. For example, the pop-up vest design disclosed herein locates the inflation trigger (i.e., pull cord) near the upper chest of the user, to provide a user with easier access to the manual inflation trigger in an emergency without interfering with the user's movement for work or sports and without inadvertently inflating the device as a result of routine sports or work activity. In contrast with the teaching of the present disclosure, prior art devices typically locate the manual inflation trigger at the waist of the user, where the manual inflation trigger may interfere with the user's movement for work or sports and where user movement due to routine sports or work activity may inadvertently activate the manual inflation trigger and unnecessarily or dangerously inflate the device unexpectedly. However, bladders configured to locate the inflation trigger (i.e., pull cord) near the upper chest of the user are not available on the market and obtaining such a bladder presents significant challenges in production. Challenges obtaining PFD bladders configured to locate the inflation trigger (i.e., pull cord) near the upper chest of the user include that existing manufacturers of inflatable bladders do not have the capability to make such bladders without retooling their production capability. This indicates such a location for the inflation trigger near the upper chest may be unique and novel, in view of the associated benefits from providing a user with easier access to the manual inflation trigger in an emergency without interfering with the user's movement for work or sports and without inadvertently inflating the device as a result of routine sports or work activity.

In the Summary above and in this Detailed Description, and the Claims below, and in the accompanying drawings, reference is made to particular features of various implementations. It is to be understood that the disclosure of particular features of various implementations in this specification is to be interpreted to include all possible combinations of such particular features. For example, where a particular feature is disclosed in the context of a particular aspect or implementation, or a particular claim, that feature can also be used—to the extent possible—in combination with and/or in the context of other particular aspects and implementations, and in an implementation generally.

While multiple implementations are disclosed, still other implementations will become apparent to those skilled in the art from this detailed description. Disclosed implementations may be capable of myriad modifications in various obvious aspects, all without departing from the spirit and scope of the disclosed implementations. Accordingly, the drawings and descriptions are to be regarded as illustrative in nature and not restrictive.

It should be noted that the features illustrated in the drawings are not necessarily drawn to scale, and features of one implementation may be employed with other implementations as the skilled artisan would recognize, even if not explicitly stated herein. Descriptions of well-known components and processing techniques may be omitted to avoid unnecessarily obscuring the implementation features.

In the present disclosure, various features may be described as being optional, for example, through the use of the verb "may;" or, through the use of any of the phrases: "in some implementations," "in some designs," "in various implementations," "in various designs," "in an illustrative example," or, "for example." For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be implemented in seven different ways, namely with just one of the three possible features, with any two of the three possible features or with all three of the three possible features.

Elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various implementations have been disclosed and described in detail herein, it will be apparent to those skilled in the art that various changes may be made to the disclosed configuration, operation, and form without departing from the spirit and scope thereof. In particular, it is noted that the respective implementation features, even those disclosed solely in combination with other implementation features, may be combined in any configuration excepting those readily apparent to the person skilled in the art as nonsensical. Likewise, use of the singular and plural is solely for the sake of illustration and is not to be interpreted as limiting.

The Abstract is provided to comply with 37 C. F. R. § 1.72(b), to allow the reader to quickly ascertain the nature of the technical disclosure and is submitted with the understanding that it will not be used to interpret or limit the scope or meaning of the claims.

In the present disclosure, all descriptions where "comprising" is used may have as alternatives "consisting essentially of." In the present disclosure, any method or apparatus implementation may be devoid of one or more process steps or components. In the present disclosure, implementations employing negative limitations are expressly disclosed and considered a part of this disclosure.

Certain terminology and derivations thereof may be used in the present disclosure for convenience in reference only and will not be limiting. For example, words such as "upward," "downward," "left," and "right" would refer to directions in the drawings to which reference is made unless otherwise stated or apparent in view of the drawings. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, are optionally present. For example, an implementation "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined) means a quantity of the number, or less than the number. For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Many suitable methods and corresponding materials to make each of the individual parts of implementation apparatus are known in the art. One or more implementation part may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described hereinabove may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112 (f). Specifically, any use of "step of" in the claims herein is not intended to invoke the provisions of 35 U.S.C. § 112 (f). Elements recited in means-plus-function format are intended to be construed in accordance with 35 U.S.C. § 112 (f).

Recitation in a claim of the term "first" with respect to a feature or element does not necessarily imply the existence of a second or additional such feature or element.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other. The terms "abutting" or "in mechanical union" refer to items that are in direct physical contact with each other, although the items may not necessarily be attached together.

The word "exemplary" is used herein to mean "serving as an example, instance, or illustration." Any implementation described herein as "exemplary" is not necessarily to be construed as preferred over other implementations. While various aspects of the disclosure are presented with reference to drawings, the drawings are not necessarily drawn to scale unless specifically indicated.

Reference throughout this specification to "an implementation" or "the implementation" means that a particular feature, structure, or characteristic described in connection with that implementation is included in at least one implementation. Thus, the quoted phrases, or variations thereof, as recited throughout this specification are not necessarily all referring to the same implementation.

Similarly, it should be appreciated that in the above description, various features are sometimes grouped together in a single implementation, Figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims reflect, inventive aspects may lie in a combination of fewer than all features of any single foregoing disclosed implementation. Thus, the claims following this Detailed Description are hereby expressly incorporated into this Detailed Description, with each claim standing on its own as a separate implementation. This disclosure is intended to be interpreted as including all permutations of the independent claims with their dependent claims.

The element descriptions and their respective reference characters used in the Drawings are summarized as follows.

100 pop-up vest
105 inner layer
110 outer layer
115 personal flotation device (PFD) access slot
120 inflation trigger
125 inflation tube access slot
130 loop
135 drawstring
700 personal flotation device (PFD)
705 zipper
800 ribs Numerous alternative forms, equivalents, and modifications will become apparent to those skilled in the art once the above disclosure is fully appreciated. It is intended that the following claims be interpreted to embrace all such alternative forms, equivalents, and modifications where applicable.

What is claimed is:

1. A flotation apparel (100) apparatus comprising:

a t-shirt shaped water sport apparel item, comprising an inner base rash guard (105) that is configured to be in contact with an upper torso of a user and an outer rash guard (110) having an inside surface and an outside surface, that is configured to be in contact with an aquatic environment, wherein the inner base rash guard (105) is sewn to the outer rash guard (110) creating a head hole at a top, a right arm hole, a left arm hole, an open bottom and a void between the inner base rash guard (105) and the outer rash guard (110);

an inflatable Personal Flotation Device (PFD) (700) comprising a bladder having a valve mechanically connected to an inflation trigger and an inflation tube, said PFD (700) located over a portion of an inside front of the inner base rash guard (105) across a shoulder area of the inner base rash guard (105), encircling a back of the head hole, within the void and sewn to the inside front of the inner base rash guard (105) between the inner base rash guard (105) and the inside front of the outer rash guard (110);

wherein the PFD (700) is configured to automatically inflate by a replaceable pressurized cannister in fluid communication with the PFD (700) when the replaceable pressurized cannister is activated by the inflation trigger (120) that is mechanically connected to the replaceable pressurized cannister; and a plurality of slots comprising at least one PFD access slot (115) and at least one inflation tube access slot (125), wherein the plurality of slots traverse the outer rash guard (110) from the outside surface to the inside surface of the outer rash guard (110), wherein the at least one PFD access slot (115) provides user access to the PFD (700) for replacing the replaceable pressurized cannister, wherein the at least one inflation tube access slot (125) provides the user access to the inflation tube, and wherein the inflation tube is configured to permit & the user to manually inflate the PFD (700) by exhalation.

2. The apparatus of claim 1 wherein the inflation trigger (120) is a pull tab proximal to the left arm hole of the outside surface of the outer rash guard (110), wherein the pull tab is configured to inflate the PFD (700) when the pull tab is activated by the user.

3. The apparatus of claim 1 wherein the inflation trigger (120) is a sensor configured to automatically inflate the PFD (700) when the sensor is wet.

4. The apparatus of claim 1 wherein the t-shirt shaped water sport apparel item further comprises ultraviolet light (UV) protection.

5. The apparatus of claim 1 wherein the replaceable pressurized cannister is located within the void of the flotation apparel, and wherein the replaceable pressurized cannister is accessible by at least one slot of the plurality of slots.

6. The apparatus of claim 1, wherein the t-shirt shaped water sport apparel item is a wet suit.

7. The apparatus of claim 1, wherein the apparatus further comprises a plurality of ribs (800) comprising boning strips disposed within the void and subsuming the PFD (700), wherein the plurality of ribs (800) are adhered to the inside surface of the outer rash guard (110), further wherein the plurality of ribs (800) are folded to create channels to provide rigid support for the PFD (700).

8. A method to make flotation apparel (100), the method comprising:

configuring a t-shirt shaped water sport apparel item, comprising an inner base rash guard (105) that is configured to be in contact with an upper torso of a user and an outer rash guard (110) having an inside surface and an outside surface that is configured to be in contact with an aquatic environment, wherein the inner base rash guard (105) is sewn to the outer rash guard (110) creating a head hole at a top, a right arm hole, a left arm hole, an open bottom and a void between the inner base rash guard (105) and the outer rash guard (110);

configuring an inflatable Personal Flotation Device (PFD) (700) comprising a bladder having a valve mechanically connected to an inflation trigger (120) and an inflation tube, said PFD (700) located over a portion of an inside front of the inner base rash guard (105) across a shoulders area of the inner base rash guard (105), encircling a back of the head hole, within the void and sewn to the inside front of the inner base rash guard (105) between the inner base rash guard (105) and the inside front of the outer rash guard (110);

wherein the PFD (700) is configured to automatically inflate by a replaceable pressurized cannister in fluid communication with the PFD (700) when the replaceable pressurized cannister is activated by the inflation trigger (120) that is mechanically connected to the replaceable pressurized cannister; and configuring a plurality of slots comprising at least one PFD access slot (115) and at least one inflation tube access slot (125), wherein the plurality of slots traverse the outer rash guard (110) from the outside surface to the inside surface of the outer rash guard (110), wherein the at least one PFD access slot (115) provides user access to the PFD (700) for replacing the replaceable pressurized cannister, wherein the at least one inflation tube access slot (125) provides the user access to the inflation tube, and wherein the inflation tube is configured to permit the user to manually inflate the PFD (700) by exhalation.

9. The method of claim 8, wherein the inflation trigger (120) is a pull tab proximal to the left arm hole of the outside surface of the outer rash guard (110), wherein the pull tab is configured to inflate the PFD (700) when the pull tab is activated by the user.

10. The method of claim 8, wherein the method further comprises configuring the inflation trigger (120) with a sensor designed to automatically inflate the PFD (700) when the sensor is wet.

11. The method of claim 8, wherein the method further comprises configuring the flotation apparel with ultraviolet light (UV) protection.

12. The method of claim 8, wherein the replaceable pressurized cannister is located within the void of the flotation apparel, and wherein the replaceable pressurized cannister is accessible by at least one slot of the plurality of slots.

13. The method of claim 8, wherein the t-shirt shaped water sport apparel item is a wet suit.

14. The method of claim 8, wherein the method further comprises configuring a plurality of ribs (800) comprising boning strips disposed within the void and subsuming the PFD (700), wherein the plurality of ribs (800) are adhered to the inside surface of the outer rash guard (110), further wherein the plurality of ribs (800) are folded to create channels to provide rigid support for the PFD (700).

* * * * *